United States Patent [19]

Sakuma et al.

[11] 4,365,127

[45] Dec. 21, 1982

[54] VACUUM POWER INTERRUPTER

[75] Inventors: Shinzo Sakuma, Yokohama; Junichi Warabi, Shimizu, both of Japan

[73] Assignees: Kabushiki Kaishi Meidensha; Kabushiki Kaisha GemVac, both of Tokyo, Japan

[21] Appl. No.: 208,686

[22] Filed: Nov. 20, 1980

[30] Foreign Application Priority Data

Nov. 26, 1979 [JP] Japan ..... 54-152582

[51] Int. Cl.[3] ..... H01N 33/66

[52] U.S. Cl. ..... 200/144 B

[58] Field of Search ..... 200/144 B

[56] References Cited

U.S. PATENT DOCUMENTS 2,615,104 10/1952 Hosford ..... 200/144 B
3,355,564 11/1967 Ranheim ..... 200/144 B
3,727,018 4/1973 Wesoloski et al. ..... 200/144 B

FOREIGN PATENT DOCUMENTS 1298448 12/1972 United Kingdom ..... 200/144 B
2010587 6/1979 United Kingdom ..... 200/144 B

*Primary Examiner*—Robert S. Macon
*Attorney, Agent, or Firm*—Lowe, King, Price & Becker

[57] ABSTRACT

A vacuum power interrupter is constituted by a vacuum vessel (21) consisting of a bell shaped metal casing (20) having substantially the same coefficient of thermal expansion as that of ceramic, and an insulating circular end plate (19, 19*a*), having a circular bore (24) in the center thereof, hermetically brazed to the opening end of the casing. The vacuum power interrupter comprises stationary and movable contact rods (38, 35), each having an electrical contact (22, 23) on the one end thereof, aligned in the axial direction of the vacuum vessel so that the latter is movable relative to the former, an arc-shield member (30) disposed within the vacuum vessel so as to surround electrical contacts, and a bellows (33) having one end hermetically brazed to the one end of the movable contact rod, and the other end hermetically brazed to the inner circumferential surface of the insulating end plate through an annular extended portion of the arc-shield member.

9 Claims, 13 Drawing Figures

VACUUM POWER INTERRUPTER

BACKGROUND OF THE INVENTION

The present invention relates to a vacuum power interrupter, and more particularly to a vacuum power interrupter wherein a vacuum vessel is constituted so that the opening end of a bell shaped metal casing is fitted over an insulating end plate.

Generally, a vacuum power interrupter, as shown in FIG. 1, comprises a vacuum vessel 4 consisting of an insulating envelope 1 of glass or ceramic, end plates 2 and 3 attached to both axial ends of the insulating envelope 1, and stationary and movable contact rods 7 and 8 having electrical contacts 5 and 6 on the respective ends disposed so that the latter is in contact with the former or away from the former within the vacuum vessel 4.

Recently, it has been intended to increase an interrupting capacity of a vacuum power interrupter. To meet with this requirement, the radius of the electrical contact is enlarged, resulting in enlarging the radius of the insulating envelope. However, it is difficult to fabricate the insulating envelope of glass or ceramic so that the accuracy of the dimension thereof is maintained within a predetermined region. Particularly, it is very difficult to sufficiently satisfy such a requirement with respect to an insulating envelope of which radius is large. If an attempt is made to fabricate such a large sized vacuum interrupter, the material constituting a vacuum vessel becomes very expensive. As a result, the cost of the vacuum power interrupter also becomes expensive.

In view of this, another type of a vacuum power interrupter is proposed as shown in FIG. 2. This type of the vacuum power interrupter comprises a vacuum vessel 12 consisting of an insulating end plate 9 of ceramic having a ring shaped projection 10 integrally formed thereon, and a metallic cup member 11 of which the opening thereof is fastened to the ring shaped projection 10 and brazed thereto. A movable contact rod 14 having an electrical contact 13 is movably in the axial direction of the vacuum vessel supported by the bottom portion 11*a* of the cup member 11 constituting the vacuum vessel 12. A bellows 15 is mounted on the cup member 11 so that the upper end thereof is hermetically brazed to the movable contact rod 14 while the lower end thereof is hermetically brazed to the bottom portion 11*a* of the cup member 11. A stationary contact rod 17 having an electrical contact 16 in contact with the contact 13 or away therefrom is inserted into the insulating end plate 9 and is hermetically brazed thereto. A cup-shaped arc-shield member 18 for preventing a stain or deterioration of the insulating end plate 9 due to a metal vapour produced when the electrical contact 13 is in contact with the electrical contact 16 or away therefrom is provided so as to surround electrical contacts 13 and 16.

With the above mentioned vacuum power interrupter shown in FIG. 2, since one end plate 9 of insulator is solely required as compaired with FIG. 1 assembly, it is possible to reduce the cost for material constituting the end plate. However, in regard to FIG. 2 assembly, in order to obtain an insulating creeping distance of the insulating plate 9 within the vacuum vessel 12 and suppress that the vacuum vessel 12 is enlarged, with the resultant that the radius of the cup member 11 is enlarged, there is provided the annular projection 10 on the insulating plate 9. In order to fabricate the annular projection 10 of the insulating pipe 9 of ceramic, it is extremely difficult to form a mold, such as a metallic pattern or pressed pattern.

Also, another drawback is pointed out that many working steps are required for correcting deformation due to contraction of ceramic being produced when molding and sintering is effected. As a result, this results in high cost of the insulating plate 9. Therefore, the vacuum power interrupter becomes expensive. Since the cup member 11 is mounted on the insulating end plate 9 so that the opening end of the cup member 11 is in contact with the upper end of the annular projection 10 of the insulating end plate 9 and brazed thereto. As a result, it is extremely difficult to become uniform the distance between the cup member 11 and the arc-shield member 18 when fabricating the vacuum vessel. As a result, a positioning tool for positioning or aligning the movable contact rod 14 with respect to the stationary contact rods 17 is required. Otherwise, it is necessary to enlarge the outer radius of the cup member so that the aligning displacement is allowed.

In general, when connecting ceramic to metal by brazing method, in view of the difference of the coefficient of thermal expansion therebetween, it is desirable that the joining or connecting surface is as small as possible. On the contrary, in view of sealing and mechanical strength at the time of joining, it is desirable that the joining or connecting surface is as large as possible. However, in the above mentioned vacuum power interrupter shown in FIG. 2, the opening end of the cup member 11 is connected to the annular projection 10 and the cup member 11 is formed with cup-shaped durable metalic rigid body. Accordingly, it is impossible to absorb or relax a thermal stress produced at the time of connection by means of brazing material due to the deformation of the cup member. As a result, there is possibility that the insulating plate 9 of ceramic may be broken. Further, another drawback is pointed out as follows: The cup member 11 is made of rigid body. The weak or fragile portion in strength is in the vicinity of its opening peripheral. This portion is connected to the insulating end plate 9 of ceramic, thereby making it possible to strengthen the durability. However, in the cup member constituting a vacuum vessel, an internal stress is apt to be concentrated in the vicinity of its opening peripheral. In this portion, there remains a therml stress at the time of joining to the insulating end plate.

As a result, this portion is considered as a most fragile part. Accordingly, when an impact produced at the time of energizing and interrupting operation is applied to this portion, there is possibility that the joining portion or the insulating plate 9 will be broken.

Furthermore, in the above mentioned vacuum power interrupter, the bellows 15 is mounted on the upper surface of the cup member 11 so that the one end thereof is fixed to the bottom portion 11*a* of the cup member 11. While the other end thereof is fixed to the circumferential surface of the movable contact rod 14. Accordingly, there is problem that the bellows is apt to be damaged at the time of assembling or connecting to an actuating unit or during operation.

A bottom portion 18*a* of the arc-shield member 18 is interposed between the electrical contact 16 and the insulating end plate 9, and is directly brazed thereto. The electrical contact 16, the arc-shield member 18, and an insulating end plate 9 of which coefficients of thermal expansion are different each other are joined in a relatively large contact surface. Accordingly, when energizing, each member is always heated.

Accordingly, the electrical contact 16, the arc-shield member 18 and the insulating end plate 9 are subject to thermal stress due to the difference of coefficient of thermal expansion therebetween. For this reason, there is possibility that the insulating end plate 9 of ceramic which is brittle material in view of mechanical strength will be broken. Since thermal conductivity of ceramic forming the insulating end plate 9 is far smaller than that of metal, when a heat produced by arc at the time of interruption transfers to the insulating end plate 9 through the electrical contact 16, and the bottom portion 18*a* of the arc-shield member 18, there is possibility that there occurs cracks due to heat on the joining or connecting surface facing to the bottom portion 18*a* of the arc-shield member 18. Further, it is pointed out that the occurrence of the cracks is promoted when an impact due to energization and interruption is applied to the aforesaid joining surface.

Another prior art vacuum power interrupter matured or laid open to public inspection are as follows U.K. Patent Specification No. 1,298,448 published on Dec. 6, 1972 discloses a vacuum vessel comprising a cylindrical metal casing, and an insulating end plate fitted into the axial end of the vacuum vessel. U.S. Pat. No. 3,727,018 patented on Apr. 10, 1973 discloses a vacuum vessel comprising a cylindrical casing of Fe-Ni-CO (KOVAR), and insulating end plates fitted into the both axial ends of the casing wherein a movable contact rod is supported by the insulating end plate through the bottom portion of a bellows. U.K. patent application GB 2010587A published on Jun. 27, 1979 discloses a vacuum vessel comprising a cylindrical metal casing, and insulating end plates fitted into the axial end of the metal casing.

In these vacuum power interrupter, it is clear that the same drawbacks mentioned in regard to the vacuum power interrupter shown in FIG. 2 are pointed out without detailed discussion.

SUMMARY OF THE INVENTION

With the above in mind, an object of the present invention is to provide a novel structure of a vacuum power interrupter essentially consisting of an insulating end plate, and a bell shaped metal casing hermetically brazed to the insulating end plate.

Another object of the present invention is to provide a vacuum power interrupter which is simple in construction and is easy to assemble.

Another object of the present invention is to provide a vacuum power interrupter which makes it possible to improve the durability and the interrupting performance.

Another object of the present invention is to provided a vacuum power interrupter structure capable of sufficiently absorb or relax thermal stress produced when a bell shaped metal casing is brazed to an insulating end plate.

Another object of the present invention is to provide a vacuum power interrupter constituted so that residual thermal stress is as minimum as possible when a bell shaped metal casing is connected to an insulating end plate by a brazing process, thereby making it possible to prevent the insulating end plate from being broken.

Another object of the present invention is to provide a vacuum power interrupter capable of sufficiently absorb or relax an impact produced when fabricating the vacuum vessel by means of brazing material in a vacuum hearth, and when the vacuum power interrupter is energized or interrupted.

Another object of the present invention is to provide a vacuum power interrupter wherein a creeping distance of an insulating end plate is enlarged.

One aspect of the present invention is that there is provided a vacuum power interrupter constituted by a vacuum vessel comprising an insulating end plate, and a bell shaped metal casing hermetically brazed to the insulating end plate, characterized in that the end plate is provided in the center thereof with a circular bore, and that a movable contact rod is disposed within the vacuum vessel so that it extends through the circular bore in the axial direction of the vacuum vessel, and that a bellows is provided at the bottom portion thereof with an annular axially extended portion and is disposed between the movable contact rod and an arc-shield member, the bellows having one end hermetically brazed in the vicinity of the one end of the movable contact rod, and the other end hermetically brazed to the inner circumferential surface of the end plate through the extended portion of the arc-shield member.

Another aspect of the present invention is that a bell shaped metal casing is provided at the opening portion thereof with an annular radially extended portion to be fitted over the outer peripheral edge of the insulating plate and hermetically brazed thereto.

Another aspect of the present invention is that an insulating end plate is provided along the outer periphery thereof with a step portion to be fitted over the end of the annular radially extended portion of the casing.

Another aspect of the present invention is that there is provided a metalized portion formed on the above mentioned step portion of the insulating end plate.

Another aspect of the present invention is that the insulating end plate is provided along the inner peripheral edge thereof with a metalized portion.

Another aspect of the present invention is that the arc-shield member is provided in the vicinity of the annular axially extended portion thereof with a step portion.

Another apsect of the present invention is that the sttionary contact rod is supported by the bottom portion of the casing through an auxiliary annular end plate.

BRIEF DESCRIPTION OF THE DRAWINGS

The features and advantages of a vacuum power interrupter according to the present invention will become more apparent from the following description taken in conjunction with the accompanying drawings, in which.

In these drawings, same reference numerals denote same or similar part of a vacuum power interrupter according to the present invention.

DETAILED DESCRIPTION OF PREFERRED EMBODIMENTS

The preferred embodiments according to the present invention will be described with reference to attached drawings.

Figure 1:
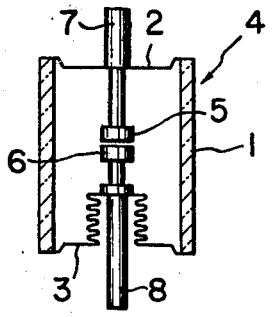
FIG. 1 (PRIOR ART)
FIG. 1 is a longitudinal cross sectional view illustrating one form of a prior art vacuum power interrupter.
Figure 2:
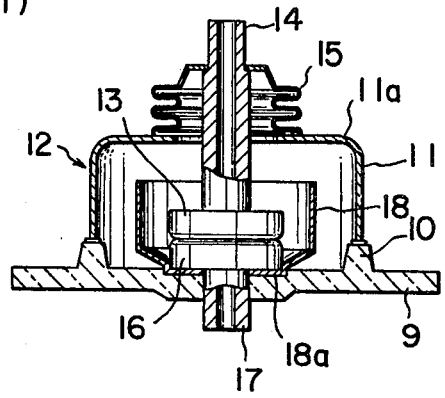
FIG. 2 (PRIOR ART)
FIG. 2 is a longitudinal cross sectional view illustrating another form of a prior art vacuum power interrupter.
Figure 3:
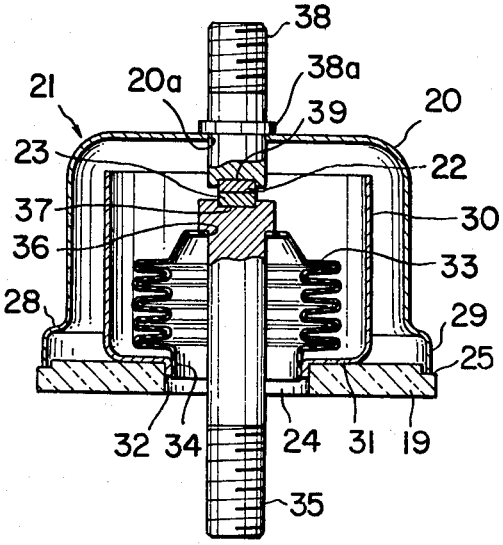
FIG. 3 is a longitudinal cross sectional view illustrating a first embodiment of a vacuum power interrupter according to the present invention.

FIG. 3 is a longitudinal cross sectional view illustrating a first embodiment of a vacuum power interrupter according to the present invention. As understood from FIG. 3, the vacuum power interrupter comprises a vacuum vessel 21 consisting of a bell shaped metal casing 20, and an insulating circular end plate 19 attached to the opening of the casing 20, and stationary and movable contact rods 38 and 35 having stationary and movable electrical contacts 22 and 23 attached on the one end thereof disposed so that the latter is in contact with the former and is away from the former.

More particularly, the insulating end plate 19 is formed with a material containing molded and sintered ceramic. The insulating end plate 19 is provided at the center thereof with a circular bore 24 and at the outer peripheral with an annular step portion 25. More particularly, as seen from FIG. 4, the insulating end plate 19 further comprises metallized layers 26 and 27 of Mo-Mn-Ti alloy or Mn-Ti alloy of which coefficient of thermal expansion is the same as that of ceramic formed on the step portion 25 and the inner peripheral surface thereof, respectively. The whole appearance of the casing 20 looks like bell shaped, which is provided in the vicinity of the opening thereof with a radially outwardly extended portion 29. Thus, a step portion 28 is formed in the vicinity of the extended portion 29. The metal casing 20 is fitted at the opening of the extended portion 29 over the step portion 25 of the insulating end plate 19. The inner peripheral surface of the opening end of the extended portion 29 is hermetically connected to the outer surface of the step portion 25 by means of a brazing material which will be described later.

It is to be noted that the method of constituting a vacuum vessel by fitting the metal casing 20 over the insulating end plate 19 by means of hermetic brazing material is not limited to the aforementioned method. Reference is made to another method with reference to FIG. 5. This method of constituting a vacuum vessel 21 comprises the steps of forming a metallized layer 26*a* on a flat portion of the step portion 25 in parallel with both end surfaces of the insulating end plate 19, fitting the extended portion 29 of the metal casing 20 over the outer circumferential surface of the step portion 25, disposing a brazing material along the outer peripheral edge of the opening end provided in the extended portion 29, and hermetically brazing metallized layer 26*a* of the step portion 25 and the opening periphery of the extended portion 29. Thus, this makes it possible to precisely position the metal casing 20 with respect to the insulating end plate 19, and makes it easy to dispose the brazing material. Further, since the brazing material is disposed outside of the metal casing 20, there is no possibility that the melted brazing material flows into the end surface of the insulating end plate 19 within the vacuum vessel 21.

Within the vacuum vessel 21 consisting of the insulating end plate 19 and the metal casing 20, there is provided a cylindrical arc-shield member 30 of Fe-Ni-CO alloy of Fe-Ni alloy which is the same material as that of the metal casing 20 so that it is disposed concentrically with the metal casing 20 with the annular fitting portion 32 extending outwardly in the axial direction from the opening provided in the central portion of the bottom portion 31 being fitted into the bore 24 of the insulating end plate 19. The arc-shield member 30 is provided for preventing stain in the inner peripheral surface of the insulating end plate 19 due to metallic vapour produced when the movable electrical contacts is in contact with the stationary electrical contact or away therefrom. The arc-shield member 30 is fixed to the insulating end plate 19 by hermetically connecting a part of the bottom portion 31 of the arc-shield member 30 with the metallized layer 27 provided in the vicinity of the periphery of the bore 24 of the insulating end plate 19. It is desirous that the width of the metallized layer is one third of the length in the radius direction of the bottom portion 31 of the arc-shield member 30.

It is here noted that the inverval between the opening of the arc-shield member 30 and the bottom portion of the metal casing 20, and the interval between the outer surface of the arc-shield member 30 and the inner circumferential surface of the metal casing are selected so as to be a vacuum insulating withstand voltage distance. It is possible to obtain a creeping distance of the insulating end plate 19 within the vacuum vessel 21 in which the metal casing 20 is connected to the arc-shield member 30 because of the fact that a part of the bottom portion 31 of the arc-shield member 30 is connected to the insulating end plate 19 and the opening periphery of the extended portion 29 of the metal asing 20 is connected to the insulating end plate 19.

Within the vacuum vessel 21, a bellows 33 of stainless steel or inconel is disposed so that it can move telescopically in the axial direction. More particularly, the cylindrical axially extended portion 34 of the bellows 33 is fitted into the annular fitting portion 32 of the arc-shield member 30. Thus, the bellows 33 is fixed to the insulating end plate 19 by hermetically brazing the opening end of the bellows 30 and the bottom portion 31 of the arc-shield member 30. Within the bellows 33, the movable contact rod 35 of Cu or Cu alloy is inserted through a bore 36 provided in the center of the bottom portion of the bellows 33 so that it is disposed concentrically with the center of the vacuum vessel 21. More particularly, the movable contact rod 35 is supported at the radially extended portion by the bellows 33 and is hermetically brazed to the bottom portion of the bellows 33. On the axial end of the movable contact rod 35, there is provided an annular recess 37. The aforementioned disk-shaped movable electrical contact 23 is fitted into the recess 37 so that it projects from the axial end surface of the movable contact rod 35.

In the center of the bottom portion of the metal casing 20, there is provided a circular bore 20*a*. The stationary contact rod 38 of Cu or Cu alloy having the stationary electrical contact 22 is inserted through the bore 20*a* so that it faces to the movable contact rod 35. More particularly, the annular flange 38*a* provided on the outer circumferential surface of the stationary contact rod 38 is in contact with the upper portion of the metal casing 20 and is hermetically brazed thereto.

There is provided a recess 39 on the axial end of the stationary contact rod 38 (see FIG. 3). The disk-shaped stationary electrical contact 22 of Cu or Cu alloy which is movable relative to the movable electrical contact 23 is fitted into the recess 39 so that it projects from the axial end thereof, and is brazed thereto.

Figure 4:
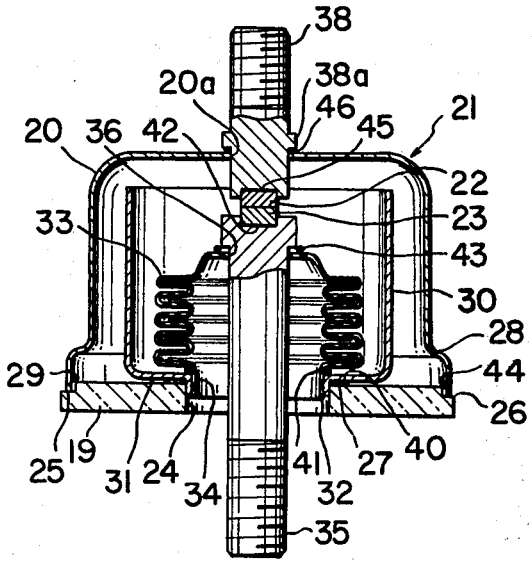
FIG. 4 is a longitudinal cross sectional view schematically illustrating a provisionally assembled condition of a vacuum power interrupter shown in FIG. 3.

Reference is now made to a method of making the afore-mentioned vacuum power interrupter. First is to mount the insulating end plate 19 having a metallized portion at a predetermined position on the base plate (not shown) so that each metallized layers 26 and 27 face upwards. Second is, as shown in FIG. 4, to mount the brazing material (plate brazing) 40 on the metallized layer 27 in the vicinity of the bore 24, mount the arc-shield member 30 so that the bottom portion 31 clamps over the brazing material 40, and fitting the annular fitting portion 32 into the bore 24. In this condition, the arc-shield member 30 is positioned so that it is disposed concentrically with the insulating end plate 19 and provisionally fixed thereto.

Third is to insert the bellows 33 so that the cylindrical portion 34 directs downwards from the upper of the arc-shield member 30, inserting the brazing material 41 between the lower end of the bellows 33 and the bottom portion 31 of the arc-shield member 30, and fixing the cylindrical extended portion 34 of the bellows 33 into the annular fitting portion 32 of the arc-shield member 30. In this condition, the bellows 33 is positioned so that it is disposed concentrically with the insulating end plate 19 and provisionally fixed thereto.

Fourth is to fit the movable electrical contact 23 into the recess 37 of the movable contact rod 35 through the brazing material 42, disposing a brazing material 43 between the radially extended portion of the movable contact rod 35 and the bottom portion 36 of the bellows 33, and inserting the movable contact rod 35 into the bore 36 of the bellows 33.

The outer end of the movable contact rod 35 is inserted into the central portion of the extended portion 34 of the bellows 33, and is positioned at a predetermined position and supported thereby.

It is to be noted that it is sufficient to assemble the movable contact rod 35 with respect to the bellows 33 prior to positioning the bellows 30 with respect to the arc-shield member 30 and provisionally fixing thereto. Further, it is sufficient to mount the movable electrical contact 23 with respect to the movable contact rod 35 after the movable contact rod 35 is fastened to the bellows 33.

Fifth is to dispose the metal casing 20 on the step portion 25 on which a metallized process is carried out through a brazing material 44, and fitting the opening of the extended portion 29 over the insulating envelope.

Figure 5:
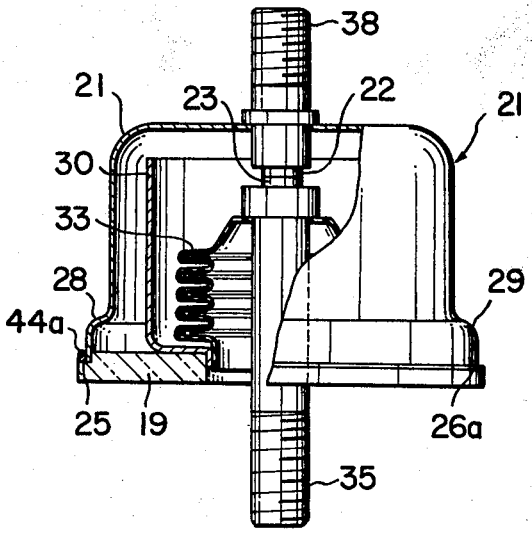
FIG. 5 is a partly cross sectional view illustrating a modification of connecting means for a casing with respect to an insulating end plate shown in FIG. 3.

Accordingly, the metal casing 20 is positioned concentrically with the insulating end plate 19, and provisionally fixed thereto. As shown in FIG. 5, when the metallized layer **26*a* is formed on the flat portion of the step portion 25, after the opening of the extended portion 29 is fitted over the step portion 25, positioned and provisionally fixed thereto, the brazing material 44*a* is mounted on the metallized layer 26*a* positioned outside of the extended portion 29**.

Sixth is to fit the stationary electrical contact 22 into the recess 39 of the stationary contact rod 38 through the brazing material 45, suspending the stationary contact rod 38 from the bore **20*a* provided in the center of the metal casing 20 through a brazing material A6 interposed between the flange 38*a* and the bottom portion of the metal casing, and dispose the stationary electrical contact 22 on the movable electrical contact 23. In this condition, the stationary contact rod 38 is positioned with respect to the metal casing 20 and provisionally fixed thereto. It is sufficient to mount the stationary contact rod 38 with the metal casing 20 prior to fastening the metal casing 20 to the insulating end plate 19. Further, it is sufficient to fit the stationary electrical contact 22 into the stationary contact rod 38 after the stationary contact rod 38 is assembled with the metal casing 20**.

Finally, seventh is to evacuate and heat the vacuum power interrupter of which components are provisionally assembled in a vacuum furnace, whereby brazing materials 40, 41, 42, 43, 44, 45 and 46 interposed between respective constituent components are hermetically brazed. Thus, a vacuum power interrupter is completed. In view of wet characteristic of the brazing material it is desirous that the heating temperature is above the temperature where plasticity deformation in regard to the metal casing 20 starts.

As is clear from the foregoing, a vacuum power interrupter according to the present invention is characterized in that the insulating end plate 19 having an uniform thickness is provided at the center thereof with the bore 24, and that the insulating end plate 19 is provided with the step portion 25 along the outer circumferential periphery of one end surface. Accordingly, the insulating end plate of the invention makes it possible to extremely simplify the formation and sintering. Further, this type of insulating end plate makes it possible to improve the accuracy of the molding and reduce the amount of material.

With respect to the insulating end plate 19 of ceramic of which is brittle and is difficult to machine, it is sufficient to machine the bore 24 and the step portion 25 in order to improve the accuracy of assembling. Accordingly, the cutting or machining work for molding is simple and the machining cost is as minimum as possible.

The metallized layers 26 and 27 provided on the insulating end plate 19 for joining the arc-shield member 30 and the metal casing 20 are provided on one end surface thereof and has a flat surface. Accordingly, it is possible to facilitate a metallized processing work.

Since the metal casing is formed with Fe-Ni-CO alloy or Fe-Ni alloy of which coefficient of thermal expansion is the same as that of ceramic, it is possible to directly connect both means without the means of which coefficient is medium therebetween.

Since, the metal casing 20 is formed to be tubular and is provided with the extended portion 29 having a step portion bent outwardly at the opening thereof, thermal stress at the time of brazing can be absorbed by this extended portion 29. Accordingly, there is little possibility that thermal stress at the time of brazing remains. Further, undesirable stress cannot be exterted on the insulating end plate 19. Accordingly, there is no possibility that the insulating end plate 19 is broken.

Since the metal casing 20 is fitted at the opening periphery of the extended portion 29 over the step portion 25 on which a metallized layer 26 is formed, it becomes easy to position with respect to the insulated end plate 19. Further, it is possible to precisely carry out positioning work.

Further, since the vacuum vessel 21 hermetically brazed after positioning is provided at the opening thereof with an extended portion 29, it is possible to withstand the pressure differential between the inside and the outside thereof, and the impact at the time of energizing and interrupting. It is possible to enlarge the creeping distance of the insulating end plate 19 between the arc-shield member 30 and the metal casing 20 within the vacuum vessel 21.

Since the arc-shield member 30 is made of Fe-Ni-CO alloy or Fe-Ni alloy each of which coefficient of thermal expansion is same as that of ceramic forming the insulating end plate 19, it is possible to directly braze the shield member 30 to the insulating end plate 19.

Since the shield member 30 is formed to be cylindrical and the annular fitting portion 32 extending from the opening in the axial direction is fitted into the bore 24, it is possible to become easy and precisely carry out position and provisionally assemble with respect to the insulating end plate 19 at the time of provisional assembling. At the time of brazing in a vacuum furnace, there is no possibility that the brazing material 40 flows into gap between bore 24 and the annular fitting portion 32. The whole surface of the bottom portion of the shield member 30 is fastened to the insulating end plate 19. The small area of the bottom portion positioned outside of the annular fitting portion 32 is partly fixed to the insulating end plate 19. Thus, the bottom portion of the shield member 30 on the both sides of fixing point can be deformed due to the thermal stress at the time of brazing, thereby making it possible to sufficiently relax even if the connection between the insulating end plate and the shield member is condition for face contact. As a result, it is possible to carry out sufficient hermetic brazing work.

Furthermore, there is little electric current, when energized, flowing through the arc-shield member 30 connected to the movable contact rod 35 through the bellows consisting of stainless steel of high electrical resistance material or inconel. Accordingly, the temperature cannot be elevated by an electric current flowing therethrough. Accordingly, it is possible to effectively capture the metal vapour produced at the time of interruption, thereby making it possible to effect successful interruption.

The positioning and provisional fixing of the bellows 33 with respect to the insulating end plate 19 can be simplified and precisely carried out by fitting the cylindrical portion 34 provided at the opening end thereof into the fitting portion 32 of the arc-shield member 30.

Since the bellows 33 is constituted so that it is connected to the insulating end plate 19 through the arc-shield member 30, it is not necessary to interpose additional means having an intermediate coefficient of thermal expansion therebetween. Further, if the outer surface of the metal casing 20 and the end portion of the extended portion of the annular fitting portion 32 of the arc-shield member 30 are coated with paint, the metal casing 20 and the shield member 30 consisting of Fe-Ni-Co alloy or Fe-Ni alloy are not directly exposed to air, thereby making it possible to prevent occurring of rust.

Figure 6:
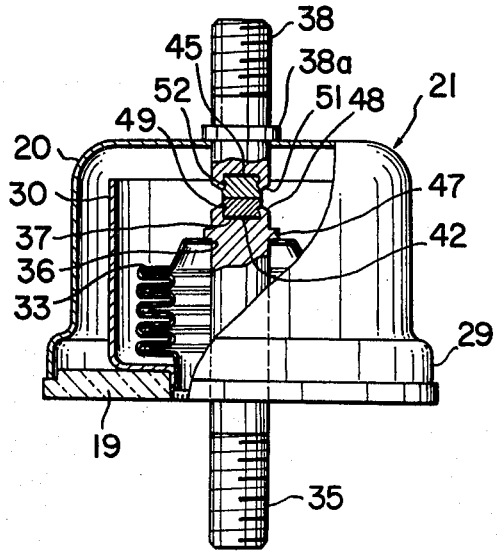
FIGS. 6 through 13 are partly cross sectional views each illustrating a vacuum power interrupter according to second to ninth embodiments of the present invention.

FIG. 6 is a partly cross sectional view of a second embodiment of a vacuum power interrupter wherein the mounting means of stationary and movable electrical contacts 22 and 23 with respect to the stationary and movable contact rods 38 and 35 is altered. The movable contact rod 35 is disposed so as to insert the bore 36 provided in the bottom portion of the bellows 33. More particularly, the movable contact rod 35 is supported at an annular flange 47 integrally formed thereon on the upper end of the bellows 33 and is hermetically connected thereto. Along the outer circumferential edge of a recess 37, there is formed a caulking portion 48.

The recess 37 is provided at the inner periphery thereof with a caulking portion 48. The movable electrical contact 23 is fitted into the recess 37 of the movable contact rod 35 so that a caulking groove 49 provided along the outer circumferential surface thereof is engaged with the caulking portion 48 of the recess 37. The movable electrical contact 23 is securely fixed to the movable contact rod 35 by heating the brazing material 42 interposed between the bottom portion of the recess 37 and the movable electrical contact 23. The stationary contact rod 38 is provided along the outer periphery of the recess 39 provided in the outer circumferential surface thereof with a caulking portion 51. The stationary electrical contact 22 along which a caulking groove 52 is formed is fitted into the recess 39 and is securely fixed due to the engagement between the caulking groove 52 and a caulking portion 51 provided along the inner periphery of the recess 39. The stationary electrical contact 22 is brazed to the stationary contact rod 38 by a brazing material 45 interposed between the bottom portion of the recess 39 and the stationary electrical contact 23.

Since remaining structure in the aforementioned embodiment is substantially the same as that of the first embodiment previously described, the explanation thereof will be omitted.

According to the second embodiment of a vacuum power interrupter, each contact 22 and 23 is engaged with each recess 39 and 37 under the condition that there is formed a gap between electrical contacts 22 and 23 to the stationary and movable contact rods 38 and 35.

At the time of brazing, the gaps are filled with brazing materials 45 and 42, thereby making it possible to improve the connecting strength and to reduce the electric registivity when energizing.

Figure 7:
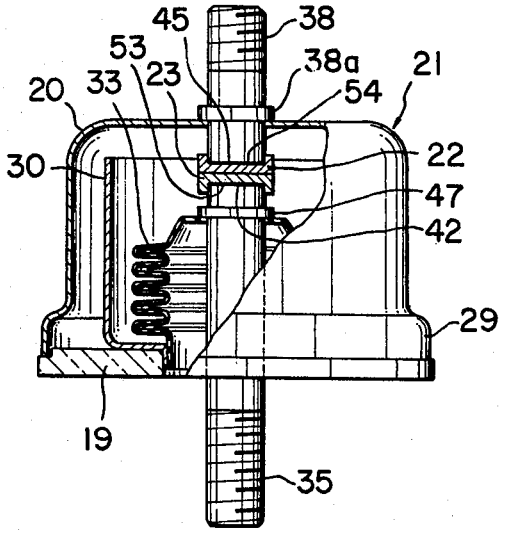

FIG. 7 is a partly cross sectional view of a third embodiment of a vacuum power interrupter wherein the outer radius of stationary and movable electrical contacts 22 and 23 is enlarged so as to enable to interrupt the interrupting electric current for large capacity. The movable contact rod 35 which is inserted through the bore 36 (see FIG. 3) provided in the bottom portion of the bellows 33 is engaged with the upper end of the bellows through a flange 47 provided in the vicinity of the axial end thereof and is hermetically brazed thereto. The disk-shaped movable electrical contact 23 of which radius is larger than that of outer radius of the movable contact rod 35 is fitted at the recess 53 provided in the axial end thereof over the axial end of the movable contact rod 35. The movable electrical contact 23 is brazed to the movable contact rod 35 by means of a brazing material 42 interposed between a bottom portion of the recess 53 and the axial end of the movable contact rod 35.

A disk shaped electrical contact 22 of which radius is larger than that of the stationary contact rod 38 is fitted over the axial end of the stationary contact rod 38. More particularly, a recess 54 provided in the electrical contact 22 is engaged with the axial end of the stationary contact rod 38. The stationary electrical contact 22 is brazed to the axial end of the stationary contact rod 38 by means of a brazing material 45 interposed between the axial end of the stationary contact rod 38 and a bottom portion of the recess 54 provided in the stationary electrical contact 22. Since remaining construction is substantially the same as that of the first embodiment, the relevant explanation will be omitted.

Although the electric current flowing through the electrical contact defined in the third embodiment is substantially the same as that of the first and second embodiments, the electrical contact of the third embodiment makes it possible to interrupt large current as compared with that of the first and second embodiments.

Figure 8:
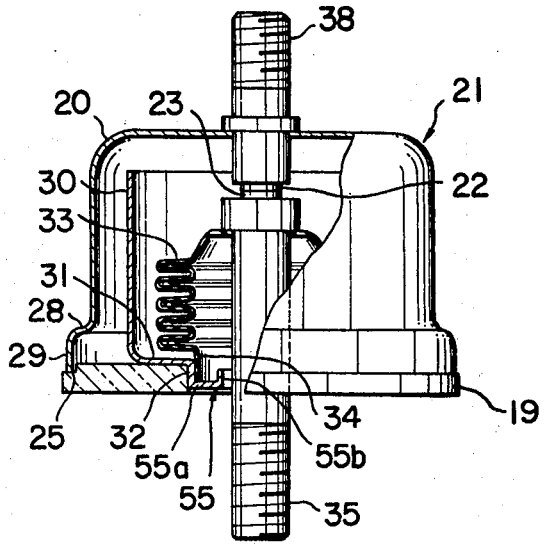

FIG. 8 is a cross sectional view illustrating a vacuum power interrupter of the fourth embodiment characterized in that there is provided a guide portion 55 for a movable contact rod 35 at the extended portion of the annular fitting portion 32 of the arc-shield member 30. More particularly, the guide portion 55 is L shaped, which comprises a flat portion 55*a* extending inwardly perpendicularly to the axial line of the vacuum vessel 21, and an annular portion 55*b* extending from the end of the flat portion 55*a* in parallel with the axial line. The flat portion 55*a* of the guide portion 55 is provided so that it is positioned inwardly spaced apart from the outer surface plane of the insulating end plate 19. The inner radius of the ring shaped portion 55*b* is larger than that of the movable contact rod 35. Remaining construction is substantially the same as that of the first embodiment. Accordingly, relevant explanation thereof will be omitted.

According to the fourth embodiment of a vacuum power interrupter, when connecting the movable contact rod 35 with the actuating unit (not shown), even if an external force is applied to the external end of the contact rod 35, a fluctuation is as minimum as possible since the fluctuation is restricted by the annular portion 55*b* of the guide portion 55. There is no possibility that the movable contact rod swings or there occurs a displacement between the axial line of the movable contact rod and a linkage rod of the actuating unit. Thus, there is no possibility that the withstand force of the bellows 33 lowers. Further, there is no possibility that electrical contacts 22 and 23 are partially in contact with the each axial end of the stationary and movable electrical contacts. Further, there is no lowering of efficiency of electrical current due to the reduction of contact area. Furthermore, an additional bearing unit is not required.

When provisionally assembling a vacuum power interrupter, it is possible to determine the positioning of bellows 33 in the axial direction by contacting the end portion of the extended portion 34 of the bellows 33 with the flat portion 55*a* of the guide portion 55. Since the length in the axial direction of the extended portion 34 is longer than that of the annular fitting portion 32 of the arc-shield member, it is possible to effectively utilize the bellows 33.

Figure 9:
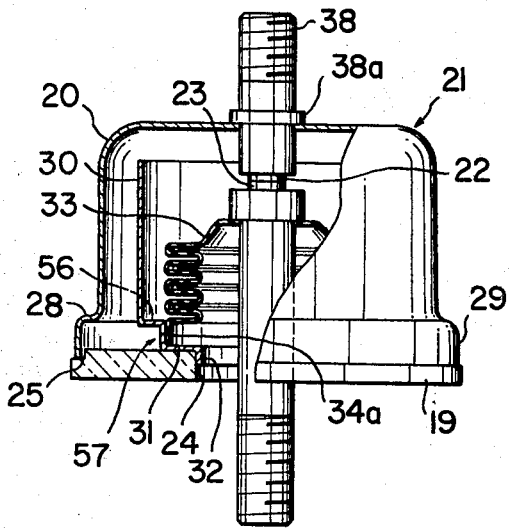

FIG. 9 is a partly cross sectional view of a fifth embodiment of a vacuum power interrupter characterized in that the arc-shield member 30 is provided at the bottom portion thereof with double step ports. More particularly, in the vicinity of bottom portion 31 of the arc-shield member 30, there is provided a bent portion 57 comprising a step portion 56 in parallel with a bottom portion 31 wherein the inner radius of the bent portion 57 is substantially the same as outer radius of the bellows 33. The extended portion 34*a* provided at the bottom portion of the bellows 33 extending in the axial direction is fitted into the inner circumferential surface of the bent portion 57 of the arc shield member 30 and is hermetically brazed thereto. When provisionally assembling, the bellows 33 is disposed concentrically with the vacuum vessel 21 by contacting the extended portion 34*a* with the inner circumferential surface of the extended portion 31. The positioning in the axial direction is carried out by contacting the end of the extended portion 34*a* with the bottom portion 31 of the arc-shield member 30. Remaining construction is substantially the same as that of first embodiment. Relevant explanation will be omitted.

According to a vacuum power interrupter defined in the fifth embodiment, since the arc-shield member 30 is provided at the bottom portion thereof with double step portions, it is possible to enlarge a creeping distance of the insulating end plate 19 between the arc-shield member 30 and the metal casing 20 within a vacuum vessel as compared with that defined in the first embodiment.

The positioning in the radial direction and axial direction is precisely carried out by fitting the extended portion 34*a* of the bellows into the inner circumferential surface of the bent portion 57 of the arc-shield member 30 and contacting the outer end of the inner surface of the bottom portion 31 of the arc-shield member.

The connecting portion (point to be brazed) with respect to the insulating end plate 19 of the arc-shield member 30 is apart from the annular fitting portion 32. The bottom portion 32 of the arc-shield member 30 except for connecting portion, that is, step portion 56 is completely separated from the insulating end plate 19. The arc-shield member 30 is provided with the aforementioned bent portion 57. These construction makes it possible to effectively absorb or relax a thermal stress due to the brazing.

Figure 10:
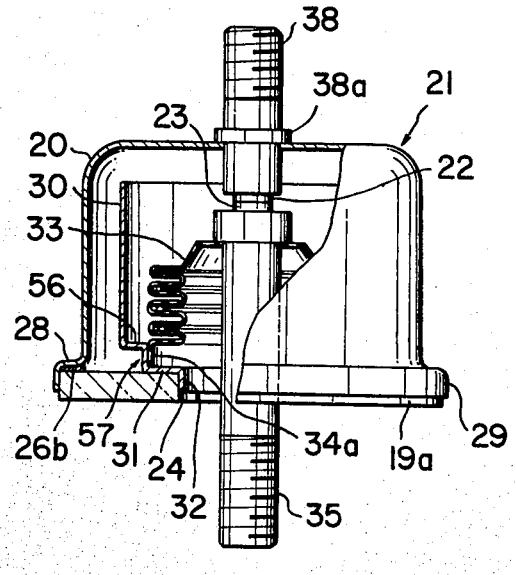

FIG. 10 is a cross sectional view illustrating a sixth embodiment of a vacuum power interrupter characterized in that the insulating end plate is formed with ring shaped disk plate without provision of a step portion along the outer periphery on one end of the insulating end plate, and that the metal casing is provided at the opening periphery thereof with a step portion to be fitted over the outer periphery of the insulating end plate 19.

In the vacuum power interrupter, the insulating end plate 19*a* of ceramic is formed with a disk shaped plate having the bore 24 in the center thereof. Along the outer circumferential surface of one end surface of the insulating end plate, there is a ring shaped layer 26*b* having a predetermined width. The metal casing 20 with the extended portion 29 is fixed to the insulating end plate 19 so that the opening portion thereiof is fitted over the outer periphery of the insulating end plate 19*a*, and the step portion 28 formed in the vicinity of extended portion 29 is in contact with a metallized layer 26*b* and fitted thereover. The vacuum vessel 21 is constituted by hermetically brazing the metallized layer 26*b* and step portion 28. The width of the metallized layer 26*b* is smaller than that of the step portion of the metal casing 20. Remaining structure is the same as that of the aforementioned fifth embodiment. Relevant explanation will be omitted.

With a vacuum power interrupter of the sixth embodiment, since the insulating end plate 19*a* is formed with disk shaped plate, it is possible to simplify the forming and sintering thereof as compaired with the preceding embodiments. The vacuum power interrupter as defined in the sixth embodiment makes it possible to improve an accuracy of molding, and eliminate the machining process. This vacuum power interrupter further makes it possible to facilitate the metallized procedure with respect to the portion for connecting the metal casing 20 and the arc-shield member 30.

When assembling the metal casing 20 with the insulating end plate 19*a*, the opening of the extended portion of the metal casing 20 is fitted over the outer circumferential surface of the insulating end plate 19*a*, and the step portion 28 is in contact with the metallized layer 26*b* of the insulating end plate 19*a*. Thus, this construction makes it possible to facilitate and precisely carry out the positioning and provisional fastening of the metal casing 20 in the radial and axial direction with respect to the insulating end plate 19*a*.

The width of the metallized layer 26*b* provided on the insulating end plate 19*a* is smaller than that of the step portion 28 of the metal casing 20. The bending point bent so as to form step portion 28 and the opening edge of the extended portion 29 of the metal casing 20 are constituted so as to deform. Accordingly, this makes it possible to relax or absorb thermal stress at the time of brazing and the impact at the time of energization or interruption.

Figure 11:
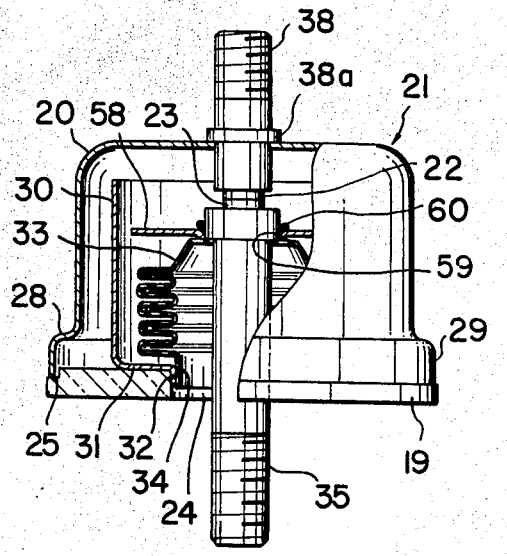

FIG. 11 is a partly cross sectional view illustrating a seventh embodiment of a vacuum power interrupter where in there is provided a bellows shield member 58 in order to prevent the bellows 33 from being injurious due to a metal varpour produced when the movable electrical contacts 23 is in contact with the stationary electrical contact 22 or away therefrom. In this type of the vacuum power interrupter, the bellows shield member 58 is provided at the center thereof with a conical hole 59. The bellow shield member 58 is fitted over the movable contact rod 35 so that the conical hole 59 is in contact with the outer circumferential surface of the movable contact rod. Thus, the bellows shield member 58 is hermetically brazed to the movable contact rod 35 together with the upper end of the bellows 33.

The inner radius of the conical hole 59 is slightly larger than outer radius of the movable contact rod 35 so that the brazing material flows into towards bellows 33. The outer radius of the bellows shield 58 is smaller than an internal radius of the shield member 30 so that the metal vapour cannot intrude into bellows 33. Reamining construction is the same as that of the first embodiment. Relevant explanation thereof will omitted.

With a vacuum power interrupter of the seventh emodiment, the inner radius of the conical hole 59 of the bellows shield member 58 is slightly larger than outer radius of the movable contact rod 35. Accordingly, this makes it possible to facilitate and precisely carry out the positioning in the radial direction. Further, the gap between the inner surface of the shield member 30 and the periphery of the bellows shield member 58 is as minimum as possible.

The brazing work is carried out under the condition that an annular brazing material 60 is disposed along the movable contact rod 35. Thus, it is possible to join the bellows 33, the movable contact rod 35, and the bellows shield member 58 at the same time by means of a brazing material 60. This makes it possible to elevate the connecting strength due to the fact that the brazing material 60 is immersed between the conical hole 59 and the movable contact rod 35.

Figure 12:
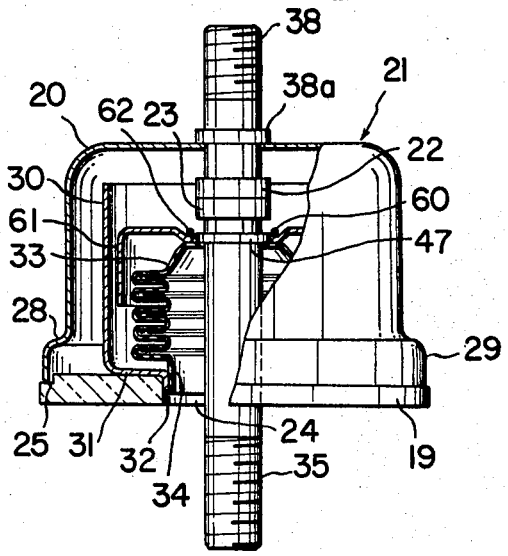

FIG. 12 is a partly cross sectional view illustrating a vacuum power interrupter of an eighth embodiment wherein the shape of the bellows shield member 61 is improved so that the vacuum power interrupter is available in the event that the amount of metallic vapour produced in accordance with an increase of capacity of interrupting electric current is increased.

The bellows shield member 61 of Fe-Ni-CO alloy or Fe-Ni alloy is fitted over and is brazed to the flange portion provided on the movable contact rod 35 through a conical hole 62 so that the opening end of the bellows shield member 61 is opposed to the bottom portion 31 of the shield member 30.

Remaining structure is substantially the same as that of the third embodiment. Relevant explanation will be omitted.

With this type of the vacuum power interrupter defined in the eighth embodiment, it is possible to protect the bellows 33 from a lot amount of metal vapour produced when interrupting large capacity of interruption of electric current.

Figure 13:
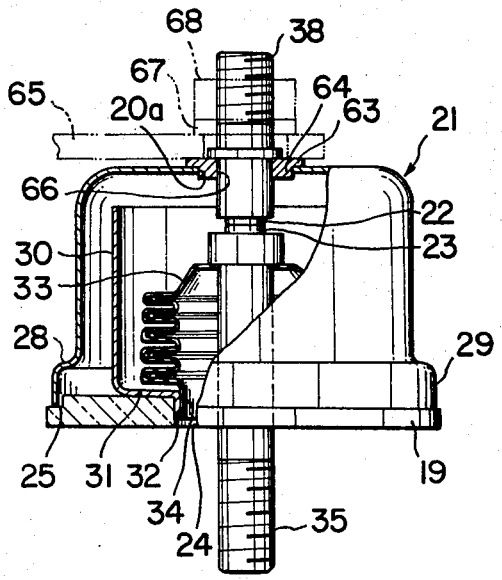

FIG. 13 is a partly cross sectional view illustrating a ninth embodiment of a vacuum power interrupter wherein the stationary contact rod 38 is connected to the metal casing 20 through an auxiliary metal end plate for collecting and electric current designated by reference numeral 63.

As shown in FIG. 13, the auxiliary end plate 63 of Cu or Cu alloy comprises an annular fitting portion 64 provided in the center thereof and projected downwardly. The auxiliary end plate 63 is fitted into the bottom portion of the metal casing 20 so that the outer circumferential surface of the fitting portion 64 is fitted into a central bore 20*a* provided in the mental casing 20 and is hermetically brazed thereto. A terminal 65 to be connected to a power source or a load is mechanically and electrically connected to the auxiliary end plate 63. More particularly, the auxiliary end plate 63 further comprises a bore 66 provided in the center thereof, through which the stationary contact rod 38 is inserted. Thus, the stationary contact rod 38 is fixed and hermetically brazed to the auxiliary end plate 63 so that the flange 38*a* integrally provided on the stationary contact rod 38 is supported by the upper portion of the auxiliary end plate 63.

The aforementioned terminal 15 is fitted over the circumferential surface of the stationary contact rod 38 so as to be in contact with the external end end of the auxiliary end plate 63 and is fixed thereto by a nut 68 threadedly engaged with the stationary contact rod 38 through a washer 67.

Remaining construction is substantially the same as that of the first embodiment. Relevant explanation will be omitted.

Accordingly, a vacuum power interrupter defined in the last mentioned embodiment makes it possible to reduce the connecting electric resistance when connecting the stationary contact rod 38 to the metal casing 20.

It is to be understood that modification and variations of the embodiments of the present invention disclosed herein may be resorted to without departing from the spirit of the invention and the scope of the appended claims.

What is claimed is:

1. A vacuum power interrupter constituted by a vacuum vessel comprising an insulating circular end plate of ceramic, and a bell shaped metal casing, having substantially the same coefficient of thermal expansion as that of ceramic, fitted over the outer periphery of said end plate and hermetically brazed thereto, the vacuum power interrupter comprising a stationary contact rod, having a stationary electrical contact on the one end thereof, supported by the bottom portion of said casing so that the one end thereof extends in the axial direction of said casing, a movable contact rod, having a movable electrical contact on the one end thereof, aligned with said stationary contact rod so that it is movable relative to said stationary contact rod, and a cylindrical arc-shield member disposed within the vacuum vessel so as to surround stationary and movable electrical contacts.

2. A vacuum power interrupter defined in claim 1, wherein said end plate is provided in the center thereof with a circular bore, said movable contact rod is disposed within the vacuum vessel so that it extends through said circular bore in the axial direction of the vacuum vessel, and a bellows is provided at the opening end thereof with an annular axially extended portion and is disposed between said movable contact rod and said arc-shield member, said bellows having one end hermetically brazed in the vicinity of the one end of said movable contact rod, and the other end hermetically brazed to the inner circumferential surface of said extended portion of said arc-shield member.

3. A vacuum power interrupter defined in claim 1 or 2, wherein said bell shaped metal casing is provided at the opening portion thereof with an annular radially extended portion to be fitted over the outer periphery of the insulating plate and hermetically brazed thereto.

4. A vacuum power interrupter defined in claim 1 or 2, wherein said insulating end plate is provided along the outer periphery thereof with a step portion to be fitted over the end of said annular radially extended portion of said casing.

5. A vacuum power interrupter defined in claim 4, wherein a first metallized portion is formed on said step portion of said insulating end plate.

6. A vacuum power interrupter defined in claim 1 or 2, wherein said insulating end plate is provided along the inner peripheral edge thereof with a second metallized portion.

7. A vacuum power interrupter defined in claim 1 or 2, wherein said insulating end plate is provided along the outer peripheral edge thereof with a third metallized portion.

8. A vacuum power interrupter defined in claim 1 or 2, wherein said arc-shield member is provided in the vicinity of said annular axially extended portion thereof with a step portion.

9. A vacuum power interrupter defined in claim 1 or 2, wherein said stationary contact rod is supported by the bottom portion of said casing through an auxiliary annular end plate.

* * * * *